United States Patent [19]

Bernhard

[11] Patent Number: 4,644,981

[45] Date of Patent: Feb. 24, 1987

[54] FILLING ELEMENT FOR FILLING MACHINES

[75] Inventor: Herbert Bernhard, Wolfsheim, Fed. Rep. of Germany

[73] Assignee: Seitz Enzinger Noll Maschinenbau Aktiengesellschaft, Mannheim, Fed. Rep. of Germany

[21] Appl. No.: 738,031

[22] Filed: May 24, 1985

[30] Foreign Application Priority Data

May 30, 1984 [DE] Fed. Rep. of Germany ..... 3420181
Apr. 20, 1985 [DE] Fed. Rep. of Germany ..... 3514441

[51] Int. Cl.[4] ..... B67C 3/06

[52] U.S. Cl. ..... 141/39; 141/91; 141/198; 141/302

[58] Field of Search ..... 141/39, 40, 44, 47, 141/89, 90, 91, 198, 286, 301, 302, 307, 392, 95, 94, 96

[56] References Cited

U.S. PATENT DOCUMENTS 4,369,820 1/1983 Ahlers et al. ..... 141/39

*Primary Examiner*—Houston S. Bell, Jr.
*Attorney, Agent, or Firm*—Becker & Becker, Inc.

[57] ABSTRACT

An electrically controlled filling element, for filling machines, having one or more actuating devices for one or more shutoff valves, which are disposed in the gas-conveying systems of the filling element and are actuated for control of the various filling processes, and/or for the valve actuating device of one or more liquid flow valves. These actuating devices are made insensitive to the penetration of moisture, for example cleaning liquid, by providing one or more of the actuating devices with a diaphragm which is operated by pressure medium, and by disposing the respective pressure medium control valves which control the supply of pressure medium separate and at a distance from the other parts of the filling element at a location of the filling machine which is protected from the entry of liquid. An additional shielding of the pressure medium control valve can be undertaken by providing a housing therefor.

16 Claims, 6 Drawing Figures

FILLING ELEMENT FOR FILLING MACHINES

BACKGROUND OF THE INVENTION

The present invention relates to a filling element for filling machines, especially for single and multi-chamber counter pressure filling machines, with the filling element including liquid introduction means which leads to the interior of a container, for example a bottle, which is pressed onto the filling element so that it can be filled; the liquid introduction means, for example a filling tube, has at least one liquid flow valve, which is under the influence of an opening spring and of an electrically controlled valve actuating device which acts counter to the opening spring; also provided is at least one gas-conveying system having at least one electrically controllable shutoff valve; such a gas-conveying system might be a return gas withdrawal system which leads from within the container which is to be filled, and which has as least one return gas flow restrictor and, associated with each of the latter, a connecting passage, at least one of which includes one of the electrically controllable shutoff valves for periodically opening and closing off the associated connection passage.

A filling element of this general type is disclosed in U.S. Pat. No. 4,369,820, issued on Jan. 25, 1983 to the Assignee of the present application. With this heretofore known filling element, the actuating device for the shutoff valve for the connecting passage of the return gas flow restrictor is an electromagnet attached directly to the lower portion of the filling element. The valve actuating device of the liquid flow valve is also formed essentially by an electromagnet which is placed upon the upper portion of the filling element. These heretofore known filling elements are deficient, especially because the shutoff valve actuating device, which contains an electromagnet as the essential actuating element, is exposed to a large extent to liquid entry from the outside due to the manner in which it is attached to the filling element, and due to its location thereon. This efficiency exists not only during cleaning of the filling element, but also to a greater or lesser extent during the overall operation, and especially when after a bottle has broken, the filling element, especially the lower portion thereof, must be intensively sprayed with cleaning fluid to remove glass splinters. Due to these conditions and necessities, it is unavoidable that after a period of time moisture enters openings provided in the housing for the supply of power and for movable parts, especially since the cleaning fluid, which is combined with wetting agents, is able after a period of time to penetrate even the most careful seals. moisture which penetrates into the interior of the electromagnets adversely affects the electrical insulation, and can therefore cause current leakage which is particularly disruptive if the electromagnet is connected to an electronic switching arrangement which controls the filling element. Furthermore, moisture which penetrates the housing of this actuating device adversely affects the ease of motion of the magnet armature.

German Offenlegungsschrift No. 20 45 238 disclosed counter pressure container and bottle filling machine having pneumatically controlled filling elements, according to which the liquid flow valve has a pneumatic control element which closes under spring pressure and is controlled by a switchable, spring-loaded two-way valve, while the line which spans the return gas flow restrictor is controlled by a pneumatically operated control valve.

However, these heretofore known filling elements with pneumatic control and pneumatic valve actuation have the deficiency that electrical probes which respond precisely and reliably to a predetermined filling height are not provided, so that no precise and uniform filling height can be achieved with such known pneumatically controlled filling elements, as is the case with electrically controlled filling elements.

It is an object of the present invention, while maintaining the high precision and uniformity of the filling height which are possible with electrical control, to improve an electrically controlled filling element for filling machines so that disruptions in operation no longer occur due to the entry of liquid into the respective actuating devices of the valves, especially into the actuating device of the shutoff valve disposed in the connecting passage for the return gas flow restrictor.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
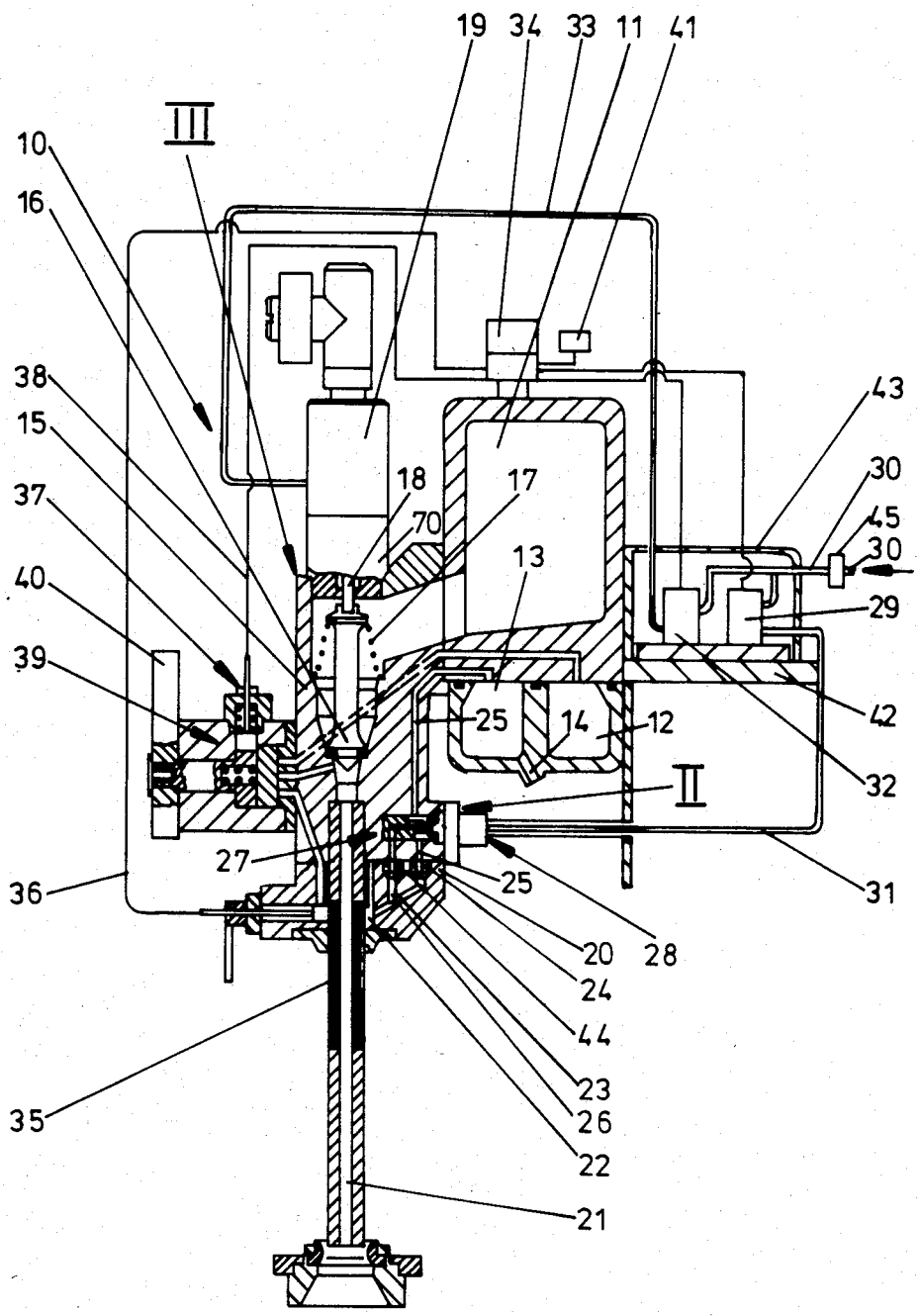
FIG. 1 is an axially sectioned view through one embodiment of an inventive filling element for a multi-chamber filling machine, and is shown in the rest position.

The filling element of the present invention is characterized primarily in that at least one of the actuating devices of the shutoff valves and of the valve actuating device contain, as an element which generates actuating force for the functioning of its valve, a respective diaphragm which is operated by pressure medium; the pressure medium supply to the diaphragm is provided with a pressure medium control valve which is mounted on the filling machine at a location which is separate and at a distance from the other parts of the filling element, and which is protected from the entry of liquid.

By providing as the element which generates actuating force for the functioning of its valve a diaphragm which is operated by pressure medium, the actuating device of the shutoff valve or the valve actuating device of the liquid flow valve becomes insensitive to the entry of moisture. Furthermore, operating the shutoff valve or the liquid flow valve with pressure medium offers the advantage that the desired alterations of the actuating force are reproducible in a simple manner by altering the operating pressure maintained in the pressure medium system. On the other hand, the advantages of the electrical control can be maintained in their entirety by providing electrically operated pressure medium control valves which are provided at locations which are protected from the entry of moisture. Such electrically operated pressure medium control valves, especially solenoid valves, can moreover be designed with less current consumption than are shutoff valve actuating devices which operate with an electromagnet, or than are liquid flow valve actuating devices which operate with an electromagnet. Such low electrical power requirement for the electrically operated pressure medium control valves is advantageous for the connection to electronic control devices of filling machines.

It is possible within the scope of the present invention to provide a shutoff valve with an actuating spring which is effective in the closing direction, and with an actuating diaphragm which is effective in the opening direction, overcomes the actuating force of the actuating spring, and is acted upon by pressure medium. Shutoff valves of this type are preferably utilized at such locations where the opening of gas conveying systems that is to be controlled is only to be opened periodically or for more or less short periods of time. Normally, such a shutoff valve is held in the closed state by its actuating spring, and is only opened temporarily or for a more or less short period of time by having pressure medium act upon the actuating diaphragm. At those locations where openings in the gas conveying system are normally opened and are only to be temporarily or for more or less short periods of time closed, suitably provided within the scope of the present invention are shutoff valves having diaphragms which operate in the closing direction and which are acted upon by pressure medium. This diaphragm can be embodied with inherent elasticity which is effective in the opening direction of the shutoff valve, and/or can operate for return by the effect of the pressure which exists in the gas-conveying system.

In either case, it is within the scope of the present invention to provide the shutoff valve with a resilient valve plate and, on its valve seat, with a flat sealing bead or seat rim which annularly surrounds the gas opening, and in the closed position of the shutoff valve is elastically moldable into the resilient valve plate; also provided for the resilient valve plate is an abutment surface which annularly surrounds the sealing bead or seat rim. With this construction, there is achieved a reliable sealing of the closed shutoff valve, together with a method of operation which protects the valve plate and the valve seat. With shutoff valves which are normally closed in operation by actuating springs, the pretension of the actuating spring can be adjusted in such a way that a sufficient closure pressure is achieved without having the danger that permanent deformations occur at the valve plate. With such shutoff valves which are to be closed by having pressure medium act upon the diaphragm, the closure force of the shutoff valve as generated by the pressure medium is absorbed and supported by the abutment surface which surrounds the sealing bead or seat rim at the valve seat to such an extent that also with these shutoff valves no permanent deformation occurs at the resilient valve plate, especially when the shutoff valve is held in the closed position for a more or less period of time.

In one preferred embodiment of the present invention, there is provided a filling element having a return gas withdrawal system and two return gas flow restrictors disposed in parallel in this system by means of branch lines. Inventively, opening and closing of one of the return gas flow restrictors is controlled by means of a shutoff valve which can be temporarily opened by having its actuating diaphragm acted upon by pressure medium, and opening and closing of the other return gas flow restrictor is controlled by means of a shutoff valve which can be temporarily closed by having its diaphragm acted upon by pressure medium.

Pursuant to another preferred embodiment of the present invention, the central portion of the diaphragm of the valve actuating device of the liquid flow valve can have an actuating plunger which acts indirectly on, i.e. on the push rod of, the liquid flow valve. The actuating plunger may be axially slideably guided in a guide bore of the housing of the valve actuating device. A pressure medium chamber can be formed in the valve actuating device behind the diaphragm, with this chamber being provided with a guide bore in which slides a rearward guide rod which is attached to the diaphragm. This valve actuating device, which is equipped with a diaphragm, can in this manner be formed on a closed unit which can be placed upon the liquid flow valve housing.

The diaphragm of the valve actuating device should preferably be designed to return merely by the influence of the opening spring of the liquid flow valve. In addition to or in place thereof, the diaphragm in the valve actuating device can be provided with inherent elasticity which is effective in the opening direction of the valve actuating device. By means of both measures, the valve actuating device is suited to have pressure medium act upon one side of the diaphragm, and it is not necessary to have a return spring for the diaphragm in the valve actuating device. In this connection, there is advantageously provided between the valve actuating device and the valve body of the liquid flow valve a guide mechanism which assures the axial guidance or movement of the valve body, and which is provided with a limit stop to define the open position of the valve body. On the one hand, this assures a defined open position of the liquid flow valve, and on the other hand the opposing coordination of the actuating forces for opening and for closing the liquid flow valve is not critical.

The actuating device of the shutoff valve, or the valve actuating device of the liquid flow valve, is preferably embodied for connection to a pneumatic pressure medium system which is independent of that pneumatic system which serves for the operation of a lifting mechanism which presses the container which is to be filled against the filling element. In this manner, the desired adaptation of the actuating force to the filling pressure can be effected by changing the operating pressure maintained in the pressure medium system. The pressure medium control valve for the actuating device of the shutoff valve, or for the actuating device of the liquid flow valve, can be an electrically controlled solenoid valve which is connected to the electrical control of the filling element.

Furthermore, the pressure medium valve for the actuating device of the shutoff valve or for the valve actuating device of the liquid flow valve can be shielded by being accommodated in a housing, with this preferably being accomplished in groups of several pressure medium valves. This shielding of the pressure medium control valve, which is in addition to the disposing the valve at a location which is protected against liquid entry, results in a considerable increase of the protection against the entry of moisture, and can be accomplished in a relatively simple manner.

For filling machines having a plurality of filling elements disposed on the outer peripheral portion of an annular liquid chamber, a particularly advantageous possibility for mounting the pressure medium control valves is to dispose the pressure medium control valves associated with the filling elements on the inner peripherial portion of this annular liquid chamber, and to convey the pressure medium lines from the pressure medium control valves through the inner peripheral region of, and below, the liquid chamber to the shutoff valves and to the liquid flow valve housing of the respective filling element. This results in a particularly protected manner of mounting the pressure medium control valves and the connecting lines which lead from the pressure medium control valves to the respective filling elements. An even further improved connection between the respective pressure medium control valve and the valve actuating device of the filling element can be achieved if the pressure medium supply line to the valve actuating device of the liquid flow valve is formed by a connector disposed on that side of the filling element facing the liquid chamber, and by channels which extend from the connector to the valve actuating device and are disposed in the liquid flow valve housing and in the housing of the valve actuating device.

DESCRIPTION OF PREFERRED EMBODIMENTS

Figure 2:
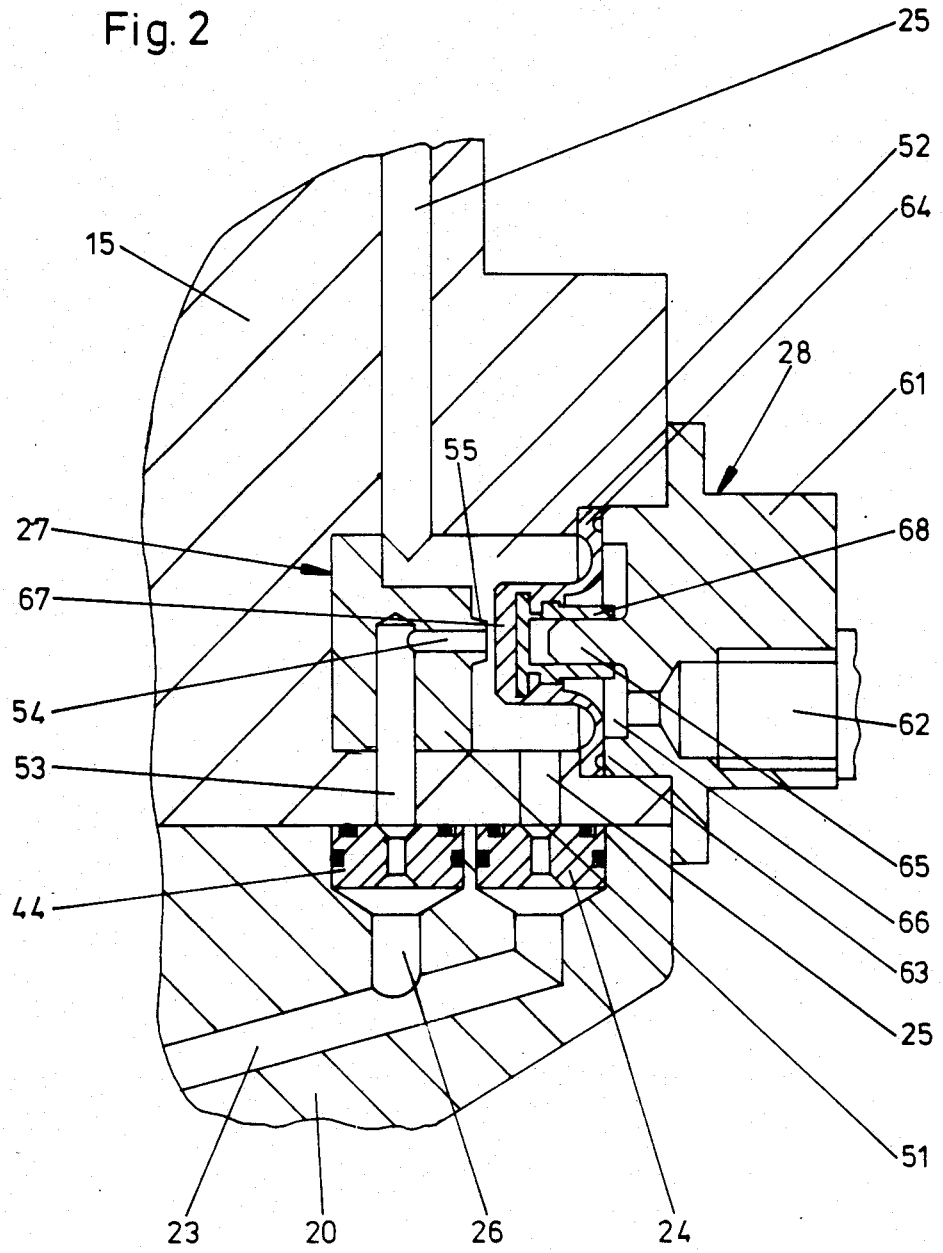
FIG. 2 is an enlarged axial section of that portion of FIG. 1 indicated by the arrow II.
Figure 3:
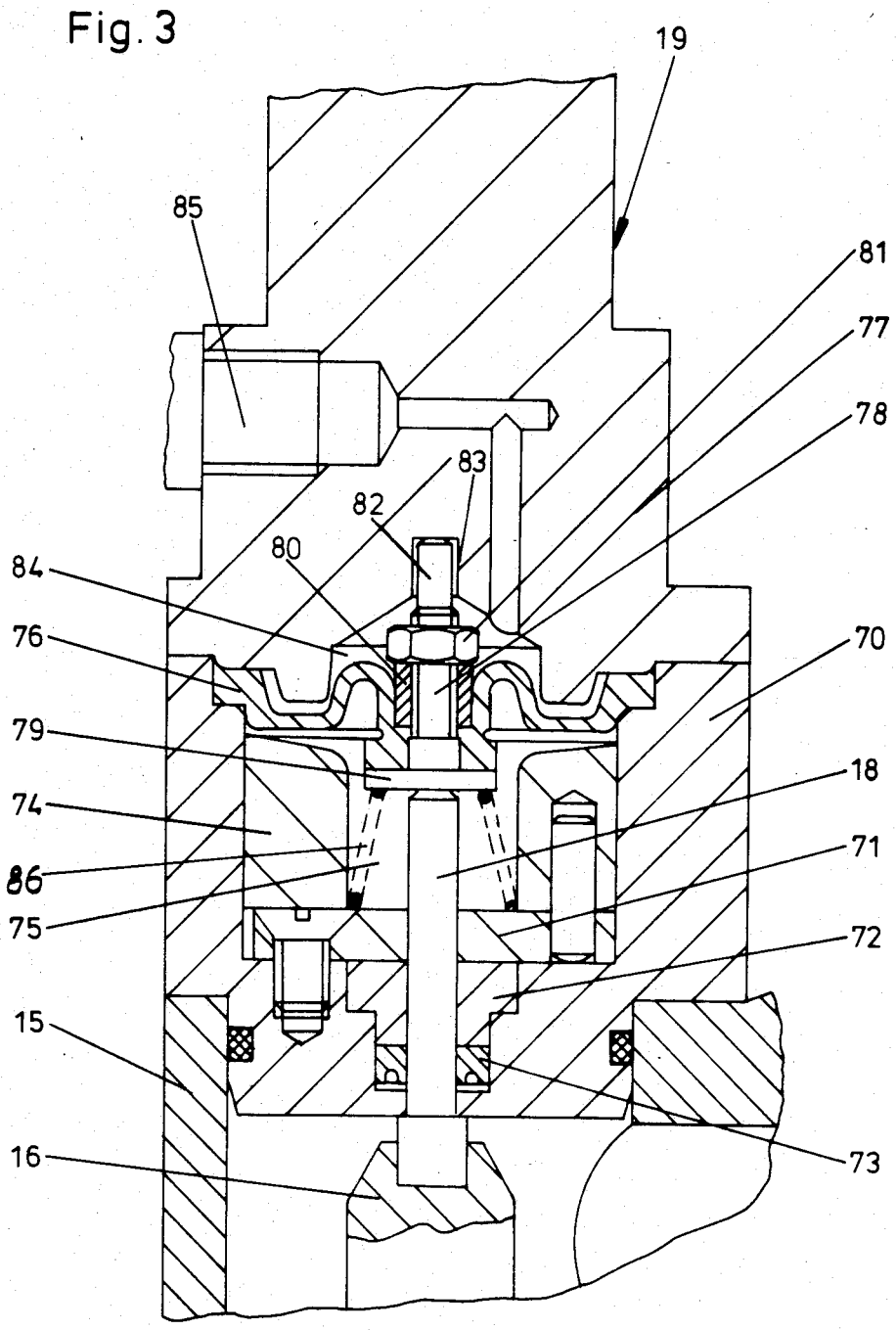
FIG. 3 is an enlarged axial section of that portion of FIG. 1 indicated by the arrow III.

Referring now to the drawings in detail, the exemplary embodiment of FIGS. 1 to 3 shows a filling element 10 for multi-chamber counter pressure-bottle filling machines. Such filling elements 10 of circulating filling machines, which are not illustrated in greater detail, are installed on an annular liquid chamber 11, the underside of which is provided with an annular pressurized gas channel 12 and an annular venting channel 13 having continuously open outlets 14 which lead to the atmosphere. The filling element 10 is provided with a housing 15 for a liquid flow valve 16, which is under the effect of an opening spring 17 which tends to urge the valve 16 to open. By means of a plunger or push rod 18, a pneumatic actuating device 19 acts upon the body of the liquid flow valve 16, which is supported upon a valve seat in the housing 15. When controlled for operation this actuating device 19 presses the valve body, counter to the force of the opening spring 17, onto the valve seat, and thus produces the closed position of the liquid flow valve 16. Attached to the underside of the housing 15 is a return gas housing 20 through which, from below, extends a filling tube 21 as far as into the housing 15. A return gas chamber 22, which surrounds the filling tube 21, is formed within the housing 20. A return gas withdrawal line 23 leads from the return gas chamber 22, via a first return gas flow restrictor 24, to a venting line 25, which is provided in the housing 15 and communicates with the annular venting channel 13. A line 26 branches off from the return gas withdrawal line 23 and is guided via a second return gas flow restrictor 44 and a shutoff valve 27 to the venting line 25. The shutoff valve 27 is provided with a pneumatic actuating device 28.

An electrically actuatable pressure medium control valve 29 is provided for the control of the actuating device 28 of the shutoff valve 27; the control valve 29 is in the form of a solenoid valve which is connected to a compressed-air line 30. This compressed-air line 30, in which is provided a compressed-air regulator 45, is a branch line of a compressed air system which is independent of the similarly not-illustrated compressed air system for operating the non-illustrated lifting mechanism with which the containers or bottles which are to be filled are pressed onto the filling element 10. A pressure medium line 31 leads from the pressure medium control valve 29 to the actuating device 28. All of the pressure medium lines 31 of a given filling machine have a uniform length and are protected from damage by means of a casing, for example a metal tube, at that location where they extend into the body region of the filling element 10.

In a similar manner, an electrically actuatable pressure medium control valve 32 is provided for the control of the pneumatic valve actuating device 19 of the liquid flow valve 16. The control valve 32 is also a solenoid valve which is connected to the compressed-air line 30, and is connected via a pressure medium line 33 with the valve actuating device 19. The pressure medium lines 33 of a given filling machine also have a uniform length and are protected from damage by means of a casing, for example a metal tube, where they extend into the body region of the filling element 10. The electrical control of the two pressure medium control valves 29 and 32 is effected from an electrical control device 34, which can be embodied as the central control device for the overall filling machine, or as the control device for the respective filling element 10. The electrical control device 34, via a signal line 36, obtains signals from an electrical signal emitter or probe 35 attached to the filling tube 21. The probe 35 is formed by an annular conductor provided on the upper portion of the filling tube 21, and emits a signal as soon as the filling height in the container which is to be filled becomes so high that the liquid, for example a beverage, comes into contact with the probe 35. The signal then emitted by the probe 35 is provided for the termination of the filling process, i.e. the actuation of the valve actuating device 19 of the liquid flow valve 16, and hence is provided for the transposition of the liquid flow valve 16 into the closed position. In the illustrated embodiment, the start of the filling process is signalled by the generation of a signal from a signalling switch 37, via a second signal line 38, to the electrical control device 34. In the illustrated embodiment, the signalling switch 37 is accommodated in a pressurized gas control arrangement 39, the control arm 40 of which is controlled by a sequence switch cam disposed on the frame of the machine.

Finally, the electrical control device 34 is provided with a timing-control element 41, the timing cycle of which can be adjusted to accommodate a slow filling phase and a rapid filling phase of the container which is to be filled.

As shown in FIG. 1, the two electrically actuatable pressure medium contol valves 29 and 32 are disposed at the rear side of the liquid chamber 11 on a central machine surface 42. In this way, the two pressure medium control valves 29 and 32 are protected or shielded from the entry of moisture, especially spray water. An additional protection is achieved by accommodating the two pressure medium control valves 29 and 32 within a housing 43. This shielding can be provided for each individual pressure medium control valve 29 or 32. However, it is also possible to combine large groups of pressure medium valves within such a housing 43, for example by accommodating therein the pressure medium control valves 29, 32 for an entire group of filling elements 10. It is also possible to accommodate the pressure medium control valves 29 for the actuating devices 28 of the shutoff valves 27 of an entire group of filling elements 10 in one housing 43, and to accommodate the pressure medium control valves 32 for the valve actuating devices 19 of this group of filling elements 10 in a separate housing 43.

As shown in FIG. 2, the shutoff valve 27 is placed in the housing 15 of the liquid flow valve 16 between the venting line 25 and the second return gas flow restrictor 44 of the return gas housing 20. The first return gas flow restrictor 24 is disposed in the housing 20 between the return gas withdrawal line 23 and the venting line 25.

In the embodiment of FIG. 2, the shutoff valve 27 is provided with a seat member 51 which is fixedly disposed in the liquid flow valve housing 15 in an opening 52 interposed in the venting line 25. The seat member 51 has a vertical blind hole 53 which is disposed above the second return gas flow restrictor 44, and has a horizontally extending return gas hole 54 which extends from the blind hole 53, and on the outlet of which is formed an annular seat rim 55 which is disposed in the free region of the opening 52 which communicates with the venting line 25.

The actuating device 28 of the shutoff valve 27 is provided with a connection and support member 61 which is to be rigidly disposed in the liquid flow valve housing 15. The outer end face of the member 61 is provided with the pressure medium connection 62, and the inner end face of the member 61 is provided with a sealing and securing ring 63 for the diaphragm 64, and also has a guide finger 65. Formed between the guide finger 65 and the sealing and securing ring 63 is a pressure medium chamber 66 which is covered by the diaphragm 64. The central portion of the diaphragm 64 is embodied as a resilient valve plate 67, behind which is disposed a sleeve-like guide element 68 which slides upon the guide finger 65. At the front end, this sleeve-like guide element 68 is provided with a plate-like head which is disposed behind the valve plate 67 and reinforces the latter. In FIG. 2, the diaphragm 64 and the guide element 68 are illustrated in a middle position, in which the gas hole 54 is opened. The diaphragm 64 can be provided with enough inherent elasticity that when the pressure medium chamber 66 is vented or evacuated, the diaphragm 64 moves into that position which completely frees the return gas hole 54. However, it is also possible to embody the diaphragm 64 of the shutoff valve 27 in such a way that when the pressure medium chamber 66 is vented, the diaphragm 64, by means of the effect of the return gas pressure, i.e. under the effect of the return gas flowing through the hole 54, moves into the open position of the shutoff valve 27. This can also be supplemented by additionally provided spring force.

As shown in FIG. 3, the valve actuating device 19 of the liquid flow valve 16 is placed upon a stopper-like cover 70 of the valve housing 15. This stopper-like cover 70 contains a central guide plate 71 for the push rod 18. Disposed at the bottom of the stopper-like cover 70, in an appropriate central recess thereof, are a guide ring 72 and a sealing member 73. An outer ring 74 is diposed on the upper side of the guide plate 71, within the cover 70, in such a way that within this ring 74 there remains a central operating or movement chamber 75 for the diaphragm 76, which operates the push rod 18. The outer peripheral edge of the diaphragm 76 is clamped between the stopper-like cover 70 and the housing 77 of the valve actuating device 19. The central portion of the valve actuating plunger 78, which in turn is provided with a plunger plate 79 which rests against the front side of the diaphragm 76, and engages the rear end of the push rod 18. The actuating plunger 78 passes through the center of the diaphragm 76, and for this purpose is embodied as a threaded rod on which is placed a fixing or clamping ring 80, and an adjusting or tightening nut 81. Beyond its threaded portion, the actuating plunger 78 is embodied as a guide rod 82 which is axially displaceable in an axial central guide bore 83 in the housing 77 of the valve actuating device 19. A pressure medium chamber 84 is formed in the housing 77 behind the diaphragm 76 and in communication with this axial bore 83; the pressure medium chamber 84 is in communication with a pressure medium inlet 85.

When the pressure in the pressure medium chamber 84 is increased, the diaphragm 76 can move as far as against the outer ring 74, whereby its central, ring-like portion, along with the plunger plate 79, displace the actuating push rod 18 of the liquid flow valve 16 to such an extent that the valve 16 (FIG. 1) is pressed into the closed position counter to the effect of the opening spring 17 (FIG. 1).

The diaphragm 76 can such inherent elasticity that when the pressure medium chamber 84 is vented or evacuated, i.e. when it has the same pressure as exists outside the housing 77, the diaphragm 76 returns on its own into the rest position illustrated in FIG. 3. However, it is also possible to embody the diaphragm 76 in a more movable manner, since then its low inherent elasticity is supplemented by the effect of the opening spring 17 (FIG. 1) when it returns to the rest position. In each case, the length of the guide rod 82 should be sufficient that when the liquid flow valve 16 (FIG. 1) is pressed into the closed position this rod 82 remains in the guide bore 83. The guide bore 83 can be coordinated with the length of the guide rod 82 in such a way that in the rest position of the diaphragm 76, the guide rod 82 abuts against the end of the guide bore 83. The return of the diaphragm 76 into the rest position can also be supplemented by additionally provided spring force, for example a compression spring 86 (FIG. 3) which acts upon the plunger plate 79. This compression spring 86 can also engage the push rod 18, for which purpose it would have to be appropriately embodied, for example by being provided with a collar.

With the counter pressure filling machine illustrated in the exemplary embodiment, at the beginning of the operating cycle not only the valve actuating device 19 of the liquid flow valve 16, but also the actuating device 28 of the shutoff valve 27 are placed under the effect of compressed air via the pressure medium control valves 32 and 29. As a result, both the liquid flow valve 16 and the shutoff valve 27 are closed.

The first operation, after the operating pressure has been set at the compressed-air regulator 45, is to introduce pressurized gas into the container which is to be filled. Both the beginning as well as the end of this operation are effected by means of the control arm 40 and the sequence switch cam of the machine. At the termination of the supply of pressurized gas, the signalling switch 37 in the pressurized gas control arrangement 39 is actuated, so that a first signal is emitted to the electrical control device 34. The pressure medium control valve 32 for the valve actuating device 19, and the timing-control element 41, are actuated with this first signal. The pressure medium control valve 32 switches the pressure medium line 33 from a supply of compressed air to a connection with the atmosphere. The pressure medium chamber 84 of the valve actuating device 19 is vented; in other words, it receives the same pressure as exists in the atmosphere. The diaphragm 76 moves into the rest position illustrated in FIG. 3, whereby the actuating plunger 78 is pulled back, and the liquid flow valve 16 is moved into the open position by the action of its opening spring 17. There initially follows a slow introduction of liquid into the container which is to be filled because the shutoff valve 27 is still closed and the return gas discharge can be effected only via the first return gas flow restrictor 24. After the termination of a first time period, as determined by the timing-control element 41, a control signal is emitted by the electrical control device for the purpose of reversing the pressure medium control valve 29 of the actuating device 28. As a result, the pressure medium chamber 66 in the actuating device 28 is vented and thus has the same pressure as the atmosphere. The diaphragm 64 returns to its rest position as a result of its inherent elasticity and/or the effect of the pressure of the return gas flowing through the hole 54, so that the shutoff valve 27 is opened and the return gas can also be discharged through the second return gas flow restrictor 44. This results in a rapid filling phase. After termination of a second time period determined by the timing-control element 41, a further control signal is emitted by the electrical control device for the purpose of again returning the pressure medium control valve 29 of the actuating device 28 to the original position. As a result, compressed air is again conveyed to the pressure medium chamber 66 of the actuating device 28. As a result of this compressed air, the diaphragm 64 is pushed forward against the seat rim 55, so that the shutoff valve 27 is closed, as a result of which the second return gas flow restrictor 44 becomes ineffective. There then again results a slow introduction of liquid into the container which is to be filled until the liquid level reaches the probe 35. At this moment, as the probe 35 is sufficiently covered, a signal is provided via the signal line 36 to the electrical control device 34. Either immediately after this signal is received, or after completion of a previously set time delay, a control signal is emitted for reversing the pressure medium control valve 32. As a result of this control signal, the pressure medium control valve 32 is returned to it original position, so that compressed air is again supplied to the pressure medium chamber 84, and the diaphragm 76 is pushed forward. In so doing, the actuating plunger 78, via the push rod 18, pushes the liquid flow valve 16 into its closed position, thus interrupting the supply of liquid to the container which is to be filled.

The further operating sequence for a subsequent filling process is effected in the above-described manner.

Figure 4:
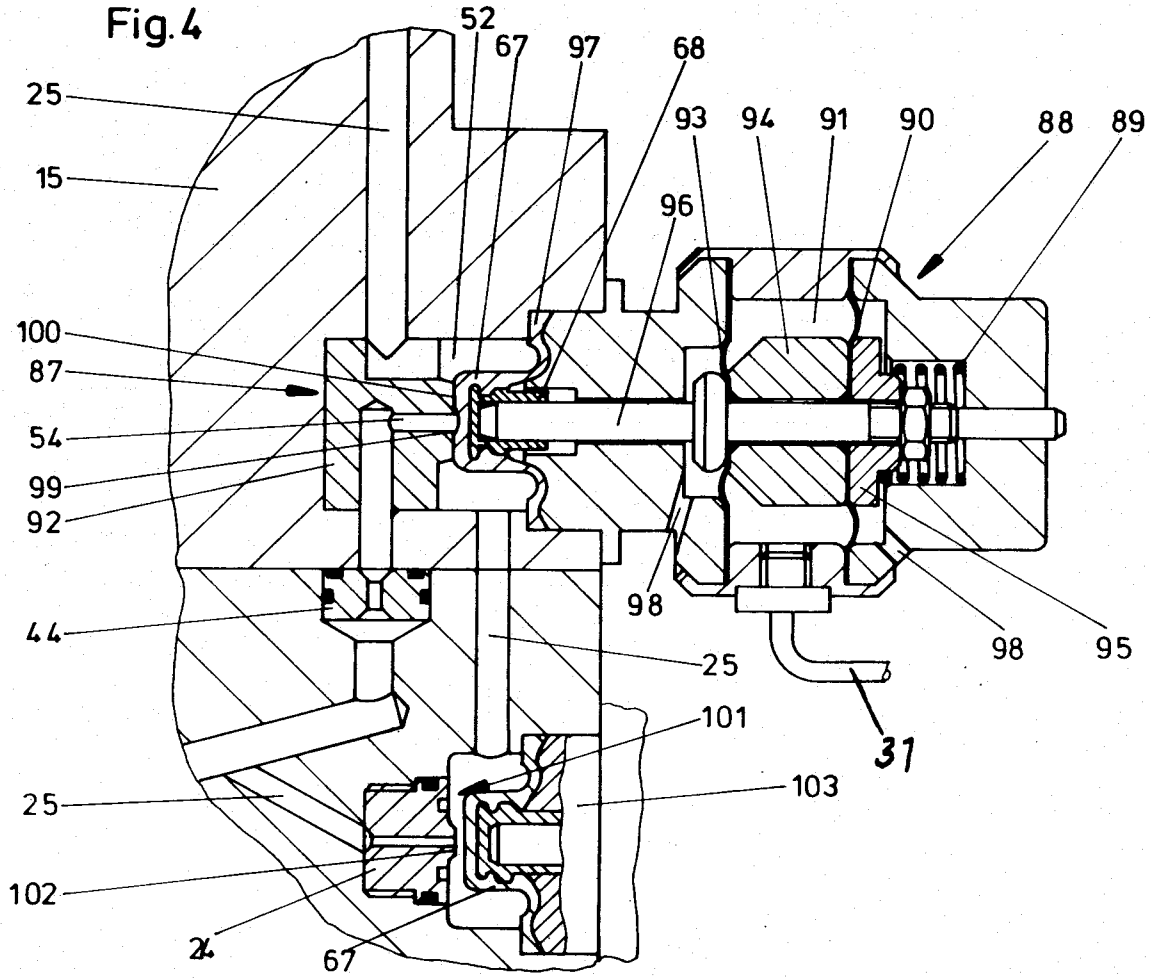
FIG. 4 is an enlargsd axial section showing a modification of the embodiment of FIG. 2 of the control devices for the return gas withdrawal system of a filling element.

In the modified embodiment of FIG. 4, the return gas withdrawal system contains a modified shutoff valve 87, the actuating device 88 of which is embodied as a unit which can be screwed into the liquid flow valve housing 15, and which contains a closing spring 89, which is under pretension, as well as an actuating diaphragm 90 which operates in the direction for opening the shutoff valve 87. The pressure medium chamber 91 associated with the diaphragm 90 is closed off on that side thereof which faces the seat member 92 by a sealing diaphragm 93, the effective surface of which is less than that of the diaphragm 90. By means of a rigid spacer 94 and an abutment plate 95 for the closing spring 89, the diaphragm 90 and the sealing diaphragm 93 are sealingly mounted on a guide finger 96, the front end of which is provided with a guide element 68 upon which is disposed a resilient valve plate 67. At its periphery, the valve plate 67 merges all around in an integral and sealing manner into a sealing ring 97, so that the venting line 25 and the opening 52 of the shutoff valve 87 in the venting line 25 are sealed off in the direction toward the actuating device 88. Those spaces formed beyond the pressure medium chamber 91 adjacent to the diaphragm 90 and the sealing diaphragm 93 within the actuating device 88 are provided with relieving and drainage bores 98 which lead to the atmosphere. A further difference between this embodiment and the embodiment of FIG. 2 is that the seat rim 99, which is embodied on the valve seat member 92 and surrounds the return gas hole 54, is flat and is surrounded by an annular abutment surface 100. In this manner, in the closed position of the shutoff valve 87, the seat rim 99 merely molds itself elastically into the resilient valve plate 67 without forming a permanent deformation at that location. The closure force of the spring 89 is reinforced by pressing the valve plate 67 against the annular abutment surface 100 which surrounds the seat rim 99, so that in this way also no permanent deformation results at the valve plate 67. Furthermore, the pretension and spring force of the closing spring 89 are coordinated with the material and the thickness of the valve plate 67, as well as with the dimensions of the seat rim 99 and the abutment surface 100, in such a way that the reaction forces caused by the effect of the closing spring 89 and acting upon the valve plate 67 can be absorbed by the latter without causing any permanent deformation thereof.

As shown in FIG. 4, if desired or required a second shutoff valve 101 can be provided in the venting line 25 in order to be able to temporarily completely shut off the return gas discharge system.

In the exemplary embodiment of FIG. 4, this second shutoff valve 101 is formed by providing the end of the first return gas flow restrictor 24 in the venting line 25 with a valve seat rim 102, across from which is placed an actuating device 103 which is only partially indicated in FIG. 4. The construction and control for the actuating device 103 can be the same as for the actuating device 88. However, the actuating device 103 is preferably provided with a diaphragm which operates in the closing direction, with an opening spring and/or the actual return force of the diaphragm and/or the pressure existing in the return gas discharge system being utilized for opening the second shutoff valve 101. For example, the construction and manner of control of the actuating device 103 could correspond to that of the actuating device 26 of the shutoff valve 27 of FIG. 2. The valve seat rim 102 of the first return gas flow restrictor 24 can also have a flat rim-like construction like the seat member 92, and can be surrounded by an annular abutment surface for the resilient valve plate 67. A seat member which is independent from the return gas flow restrictor 24 can also be provided in the second shutoff valve 101.

In the event that a second shutoff valve 101 is used, a separate pressure medium control valve should be provided for each of the two shutoff valves 87 and 101, or the pressure medium control valve 29 of FIG. 1 should be provided with additional control functions.

The utilization of the shutoff valve 87 together with or without a second shutoff valve 101 results in the following modifications in the operation of the filling element: At the beginning of the operating cycle described previously in connection with the embodiment of FIGS. 1 to 3, the shutoff valve 87 is held in the closed position by the spring 89 without being subjected to pressure medium via the actuating device 88.

If a second shutoff valve 101 is provided, the latter is moved into the closed position at the beginning of the operating cycle, so that the return gas discharge system is completely closed off by the two shutoff valves 87 and 101 during the supply of pressurized gas, so that no pressurized gas can be lost through the discharge system.

By means of the return gas flow restrictor 24, which has either been released or is always free when no second shutoff valve 101 is provided, there initially results, just like in the embodiment of FIGS. 1 to 3, a slow introduction of liquid into the container which is to be filled. After completion of a first filling time, which can be set at the timing-control element 41 (FIG. 1), pressure medium is supplied to the pressure medium chamber 91 in the actuating device 88 from the pressure medium control valve 29 (FIG. 1). The force generated by the pressure medium against the diaphragm 90 and transmitted to the guide finger 96 is greater than the closure force of the spring 89, so that the shutoff valve 87 moves into its open position and return gas can be withdrawn via the second return gas flow restrictor 44. The accelerated filling process then results, at the end of which, as with the embodiment of FIGS. 1 to 3, a slow supply of liquid into the container which is to be filled is again undertaken. For this purpose, a further control signal causes the pressure medium control valve (FIG. 1) to discontinue having pressure medium act upon the diaphragm 90 in the actuating device 88; in other words, the pressure existing in the pressure medium chamber 91 is adjusted to the atmospheric pressure. The shutoff valve 87 is then moved into its closed position by the closing spring 89. In other respects, the operating cycle is the same as that of the embodiment of FIGS. 1 to 3. However, the signal emitted when the probe 35 is covered can also be used to again move the shutoff valve 101 into the closed position like the shutoff valve 87, so that subsequent to the equilibrium which follows the filling process, the relieving of the filled container can be precisely undertaken by opening one of the shutoff valves 87 or 101, or by shifting the pressurized gas control arrangement 39 into a position provided for the relief.

Figure 6:
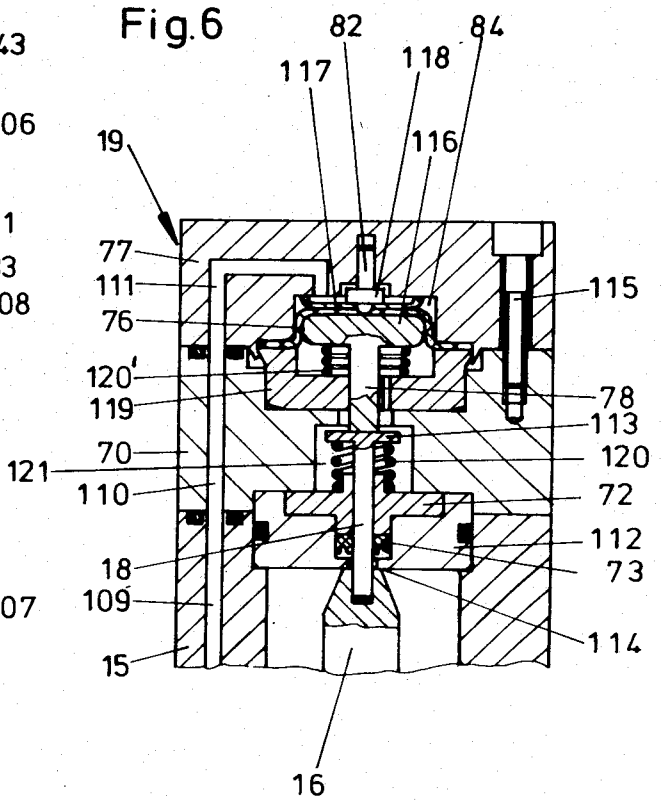
FIG. 6 is an enlarged axial section of that portion of FIG. 5 indicated by the arrow VI.
Figure 5:
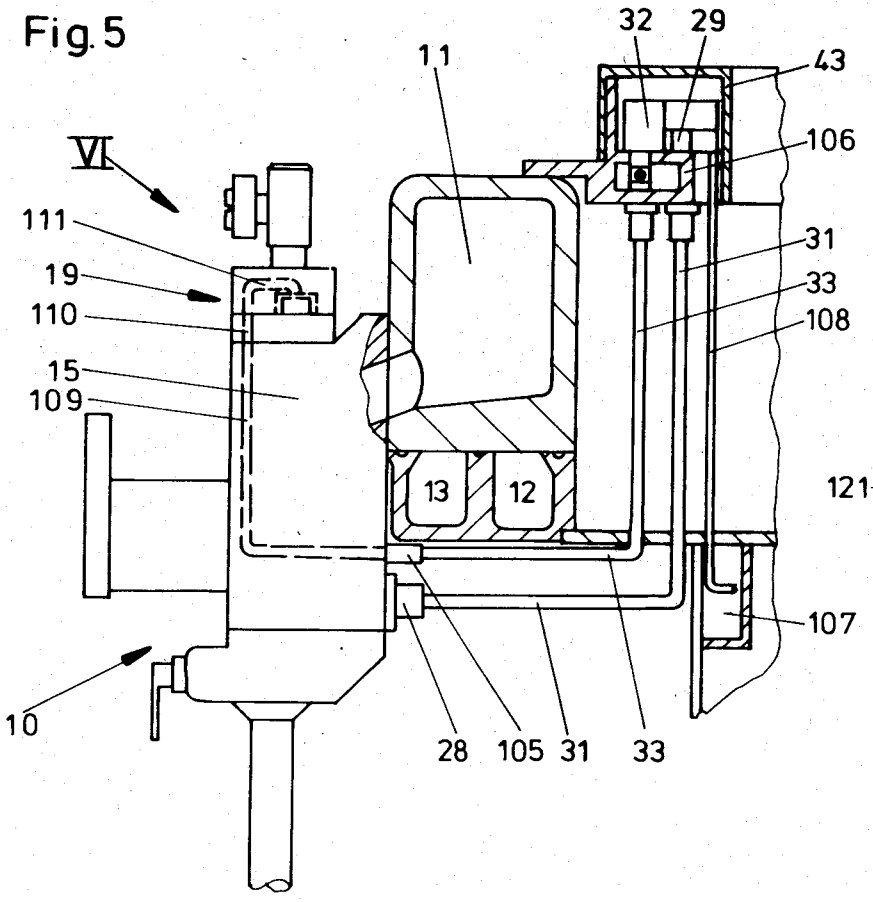
FIG. 5 is a section view of an inventively modified embodiment of a filling element partially illustrating the annular liquid chamber which supports the filling element.

In the modified embodiment illustrated in FIGS. 5 and 6, the filling element 10, which as in the embodiment of FIG. 1 is placed on the outer periphery of a liquid chamber 11 of the filling machine, is provided with a control gas connection 105 on that side which is connected to the liquid chamber 11. In this embodiment, the pressure medium control valves 29 and 32 are placed in groups on an annular control gas channel 106 in conformity to their association with the respective filling element 10. The annular control gas channel 106 is attached to the inner periphery of the upper portion of the annular liquid chamber 11, and is centrally supplied with control gas, especially compressed air. The pressure medium control valves 29 and 32, which are seated on the annular control gas channel 106, are covered by an annular housing 43 and are effectively protected by their location of attachment and by the housing 43 against the entry of liquid, especially the entry of cleaning liquid. The electrical control lines are disposed in a control line channel 107 mounted within the machine. The electrical control lines 108 to the pressure medium control valves 29 and 32 are guided upwardly from the control line channel 107 along the inner peripheral surface of the annular liquid chamber 11. The pressure medium line 31 which leads to the actuating device 28 of the shutoff valve, and the pressure medium line 33 which leads to the valve actuating device 19 of the liquid flow valve, are guided along the inner peripheral surface of the annular liquid chamber 11 from the pressure medium control valves 29 and 32, i.e. from the control gas channel 106, downwardly and below the annular liquid chamber 11, or below the annular pressurized gas channel 12 and annular venting channel 13 disposed below the liquid chamber 11, to the actuating device 28 and to the control gas connection 105. The end sections of these pressure medium lines 31 and 33, or of those portions of the latter which extend below the liquid chamber 11, can be in the form of flexible, hose-like elements.

Between the control gas connection 105 and the inlet into the pressure medium chamber 84 of the valve actuating device 19, the pressure medium line which leads to the valve actuating device 19 of the liquid flow valve 16 is guided as the pressure medium line 109, or as a bore, through the liquid flow valve housing 15, as the pressure medium line 110, or as a bore, through the cover 70 of the housing 15, and finally as the pressure medium line 111, or as a bore, through the housing 77 of the valve actuating device 19. In this manner, the supply of pressure medium to the valve actuating device 19 is also protected in the region of the filling element 10 against entry of any type of liquid.

In the modification illustrated in FIG. 6, the push rod 18 is under the influence of a compression spring 120. For this purpose, the cover 70 is provided with a stopper portion 112 in which are placed the guide ring 72 and the sealing member 73 (see FIG. 3). In this embodiment, the push rod 18 of the liquid flow valve 16 is provided at its upper end with an abutment plate 113, against the upper side of which the actuating plunger 78 of the valve actuating device 19 engages. The compression spring 120 is placed between the abutment plate 113 and the guide ring 72, with the length of the push rod 18 being set in such a way that the liquid flow valve 16, in its open position, rests against the limit stop 114 formed on the underside of the stopper portion 112; as a result, the liquid flow valve 16 assumes a defined position in the open position.

In this embodiment, the valve actuating device 19 is embodied as a closed structural unit which can be placed upon the upper side of the cover 70, where it can be secured by bolts 115. In this embodiment, the diaphragm 76 is held between a support and guide plate 116 provided on the actuating plunger 78, and an abutment plate 117 provided on the guide rod 82, i.e. is clamped in place by means of a nut 118 screwed onto the guide rod 82. The unit which forms the valve actuating device 19 is closed off toward the bottom by a limit and guide cover 119, the peripheral edge of which is held in place by a bead or flanged edge formed on the underside of the housing; the peripheral region of the diaphragm 76 is clamped in in this fashion. In order to assure that when the valve actuating device 19 is removed from the liquid flow valve housing 15, the actuating plunger 78 is retracted and held in a defined position, a retraction spring 120' can be disposed between the support and guide plate 116 and the limit and guide cover 119. When the valve actuating device 19 is removed, as well as in the pressure-relieved state of the diaphragm, the upwardly curved peripheral edge of the abutment plate 117 rests against the upper end face of the pressure medium chamber 84 and thereby assures a defined rest position of the diaphragm 76 and of the actuating plunger 78. The reference numeral 121 indicates an opening which serves as a window through which the position of the push rod 18 can be checked.

The present invention is, of course, in no way restricted to the specific disclosure of the specification and drawings, but also encompasses any modifications within the scope of the appended claims.

What I claim is:

1. A filling element for filling machines, said filling element including liquid introduction means which leads to the interior of a container pressed onto said filling element so that it can be filled; said liquid introduction means has at least one liquid flow valve, which is under the influence of an opening spring and of an electrically controlled valve actuating device which acts counter to said opening spring; also provided is at least one gas-conveying system having at least one electrically controllable shutoff valve; the improvement comprises:

a respective electrically controlled actuating device for each of said shutoff valves, with at least one of said actuating devices of said at least one shutoff valve and of said at least one liquid flow valve containing, as an element which generates actuating force for the functioning of its valve, a respective diaphragm which is operated by pressure medium;

pressure medium supply means for supplying said pressure medium to each of said diaphragm; and pressure medium control valve means for said supply means, with said control valve means being mounted on said machine at a location which is separate and at a distance from other parts of said filling element, and which is protected from the entry of liquid.

2. A filling element according to claim 1, which includes a shutoff valve, the actuating device of which has an actuating spring which acts in the closing direction, and has an actuating diaphragm which acts in the opening direction, overcomes the actuating force of said actuating spring, and is acted upon by pressure medium.

3. A filling element according to claim 2, in which said shutoff valve includes a resilient valve plate, and a valve seat member which has a hole through which gas is conveyed; said valve seat member also has a flat seat rim which annularly surrounds said gas hole and which is elastically moldable into said resilient valve plate in the closed position of said shutoff valve; said valve seat member is further provided, for said resilient valve plate, with an abutment surface which annularly surrounds said seat rim.

4. A filling element according to claim 3, which includes a sealing diaphragm which is disposed between said valve seat member and said actuating diaphragm in such a way as to form a pressure medium chamber between the latter and said sealing diaphragm, with the effective surface of the latter being less than that of said actuating diaphragm.

5. A filling element according to claim 1, which includes a shutoff valve, the actuating device of which has a diaphragm which acts in the closing direction and is acted upon by pressure medium; said diaphragm, in the absence of said pressure medium, is adapted to move in the opening direction as a result of at least one of its inherent elasticity and the pressure of gas in said gas-conveying system.

6. A filling element according to claim 5, in which said shutoff valve includes a valve seat member which has a hole through which gas is conveyed; which includes a resilient valve plate which is integral with said diaphragm and covers said gas hole of said valve seat member when said shutoff valve is in the closed state; in which the central portion of said diaphragm, on that side of said resilient valve plate remote from said gas hole of said valve seat member, is provided with a guide element; and in which said actuating device is provided with a cooperating guide manner on which said guide element slides.

7. A filling element according to claim 1, in which said gas-conveying system is a return gas withdrawal system which leads from within said container which is to be filled, and which has two parallel-operating branch lines, each of which is provided with a flow restrictor; one of said flow restrictors is provided with a shutoff valve having an actuating diaphragm which, when acted upon by pressure medium, effects a temporary opening of its shutoff valve; the other of said flow restrictors is provided with a shutoff valve having a diaphragm which, when acted upon by pressure medium, effects a temporary closing of its shutoff valve.

8. A filling element according to claim 1, in which said valve actuating device of said liquid flow valve has a housing which is provided with a guide bore; in which said liquid flow valve includes a push rod; and in which said valve actuating device of said liquid flow valve has a diaphragm, the central portion of which is provided with an actuating plunger which engages said push rod and is axially slidingly guided in said guide bore.

9. A filling element according to claim 8, in which said housing of said valve actuating device of said liquid flow valve is provided with a pressure medium chamber on that side of said diaphragm remote from said liquid flow valve; in which said guide bore of said housing communicates with said pressure medium chamber; and in which said actuating plunger has connected thereto, on that side remote from said push rod, a guide rod which slides in said guide bore.

10. A filling element according to claim 8, in which said diaphragm of said valve actuating device, in the absence of said pressure medium, is adapted to move in the opening direction of said valve actuating device as a result of at least one of the influence of said opening spring of said liquid flow valve, and the inherent elasticity of said diaphragm.

11. A filling element according to claim 1, in which said liquid flow valve has a valve body; in which a guide mechanism is provided between said valve actuating device and said valve body of said liquid flow valve; and in which said guide mechanism assures an axial movement of said valve body, and is provided with a limit stop which defines the open position of said valve body.

12. A filling element according to claim 1, in which said pressure medium supply means for said diaphragms of said actuating devices of said shutoff valves and said liquid flow valve are connected to a pneumatic pressure medium system which is independent of a pressure medium system provided for operating a lifting mechanism for pressing a container onto said filling element.

13. A filling element according to claim 1, which includes an electrical control mechanism for said filling element, and in which said pressure medium control valve means comprises respective pressure medium control valves in the form of electrically controlled solenoid valves which are connected to said electrical control mechanism of said filling element.

14. A filling element according to claim 1, which includes a housing for accommodating said pressure medium control valve means in a shielded manner.

15. A filling element according to claim 1, in which said filling machine has an annular liquid chamber; which includes a plurality of said filling elements disposed on the outer peripheral region of said liquid chamber; in which said pressure medium control valve means associated with said filling elements are disposed on the inner peripheral region of said liquid chamber; in which each of said liquid flow valves has a housing; and in which said pressure medium supply means are guided from said pressure medium control valve means, through the inner peripheral region of said machine, and below said liquid chamber, to said shutoff valves and to said housings of said liquid flow valves.

16. A filling element according to claim 15, in which said pressure medium supply means to said diaphragm of said valve actuating device of said liquid flow valve includes a connector on that side of said filling element which faces said liquid chamber, and channels which lead from said connector, through said liquid flow valve housing and the housing of said valve actuating device, to the latter and the diaphragm thereof.

* * * * *